US008262824B2

(12) United States Patent
Lee

(10) Patent No.: US 8,262,824 B2
(45) Date of Patent: Sep. 11, 2012

(54) METHOD FOR MANUFACTURING ELECTRET DIAPHRAGM

(75) Inventor: Fang Ching Lee, Taoyuan (TW)

(73) Assignee: HTC Corporation, Taoyuan County (TW)

( * ) Notice: Subject to any disclaimer, the term of this patent is extended or adjusted under 35 U.S.C. 154(b) by 221 days.

(21) Appl. No.: 12/605,142

(22) Filed: Oct. 23, 2009

(65) Prior Publication Data

US 2010/0101703 A1 Apr. 29, 2010

(30) Foreign Application Priority Data

Oct. 27, 2008 (TW) ..... 97141128 A

(51) Int. Cl.
*H04R 7/22* (2006.01)

(52) U.S. Cl. ..... 156/150; 29/594; 29/609.1; 29/886; 181/168; 381/191

(58) Field of Classification Search ..... 156/91, 156/150, 272.6; 29/594, 609.1; 181/168; 381/191

See application file for complete search history.

(56) References Cited

U.S. PATENT DOCUMENTS

| | | | | | |
|---|---|---|---|---|---|
| 3,612,778 | A * | 10/1971 | Murphy | 381/191 |
| 3,812,575 | A * | 5/1974 | Hedman | 29/594 |
| 4,042,438 | A * | 8/1977 | Kawakami et al. | 29/886 |
| 4,249,043 | A * | 2/1981 | Morgan et al. | 381/170 |
| 4,286,122 | A * | 8/1981 | Iding | 381/163 |
| 4,891,843 | A * | 1/1990 | Paulus et al. | 381/191 |
| 5,178,726 | A * | 1/1993 | Yu et al. | 216/66 |
| 5,392,358 | A * | 2/1995 | Driver | 381/191 |
| 6,013,353 | A * | 1/2000 | Touhsaent | 428/203 |
| 7,287,327 | B2 | 10/2007 | Ito et al. | |
| 7,610,670 | B2 | 11/2009 | Akino | |
| 2008/0230171 | A1 * | 9/2008 | Mei et al. | 156/150 |

FOREIGN PATENT DOCUMENTS

| | | | |
|---|---|---|---|
| CN | 2061748 | | 9/1990 |
| CN | 1997243 | | 7/2007 |
| CN | 201031253 | | 3/2008 |
| JP | 2004072235 | A | 3/2004 |
| JP | 2005094384 | A | 4/2005 |
| JP | 200515151026 | A | 6/2005 |
| JP | 2008042436 | A | 2/2008 |
| JP | 2008147899 | A | 6/2008 |
| JP | 2008172413 | A | 7/2008 |
| TW | I 264960 | B | 10/2006 |
| TW | I 293233 | | 2/2008 |
| TW | I 294250 | | 3/2008 |
| TW | I 312638 | | 7/2009 |

* cited by examiner

*Primary Examiner* — Richard Crispino
*Assistant Examiner* — Elizabeth Royston

(57) ABSTRACT

A method for manufacturing electret diaphragms is provided. First, a dielectric film is attached to a frame by an adhesive material and a fastening element grips the peripheral area of the dielectric film on the frame. Afterward, the dielectric film is subjected to a metal sputtering process to form a conductive material layer thereon. Finally, the dielectric film is subjected to a polarizing process thereby forming an electret diaphragm.

20 Claims, 4 Drawing Sheets

METHOD FOR MANUFACTURING ELECTRET DIAPHRAGM

CROSS REFERENCE TO RELATED APPLICATION

This application claims the priority benefit of Taiwan Patent Application Serial Number 097141128 filed Oct. 27, 2008, the full disclosure of which is incorporated herein by reference.

BACKGROUND OF THE INVENTION

1. Field of the Invention

The invention relates to a method for manufacturing a film, and more particularly, to a method for manufacturing an electret diaphragm for an electret electro-acoustic transducer.

2. Description of the Related Art

Loudspeakers are a kind of device to make sound. The principle of making sound for the loudspeakers is to vibrate the diaphragms thereof by electrical signals to push the air. Nowadays, the loudspeakers have been broadly used in the electronic devices with the function of making sound, such as mobile phones, personal digital assistants (PDAs) and laptop computers.

One of the common loudspeakers is so-called dynamic loudspeaker. The principle of making sound for the dynamic loudspeaker is to drive a current through the voice coil to produce a magnet field. This magnetic field causes the voice coil to react to the magnetic field from a permanent magnet fixed to the frame of the loudspeaker thereby vibrating the diaphragm attached with the voice coil so as to make sound. Although such dynamic loudspeaker can provide very good quality of sound, the loudspeaker has a considerable thickness because its sound chamber is large. When such dynamic loudspeakers are used in the above portable electronic devices, the thickness of these electronic devices cannot be reduced.

In order to solve the above problem, a so-called electret loudspeaker is manufactured. The electret loudspeaker includes a flexibly dielectric film to act as a diaphragm. The dielectric film has a conductive material formed thereon to function as an electrode. After the conductive material is formed, the dielectric film is polarized to generate static charges therein and thereon. A discussion about the electret loudspeakers can be found on the Taiwan Patent No. I293233, entitled "FLEXIBLE LOUDSPEAKER AND ITS FABRICATING METHODS".

However, the diaphragm manufactured by the conventional processes has a problem that the conductive material is prone to come off the dielectric film. This will lead to an adverse effect on the performance of the electret loudspeaker. Furthermore, the mass production of the electret loudspeakers is hard to be achieved by conventional processes.

SUMMARY OF THE INVENTION

A method for manufacturing electret diaphragms according to the present invention is provided. The vacuum tape or clamping fixture is used to stretch the dielectric film tautly over the frame and the conveyers are used to expedite the production of the electret diaphragms.

In one embodiment, the method of the present invention is to apply an adhesive material to the upper surface of a frame and a dielectric film is attached to the upper surface of the frame. When the film is used as the diaphragm of an electro-acoustic transducer, the film has a thickness of 1 to 50 μm.

After the film is attached to the frame, a vacuum tape or clamping fixture as a fastening element grips the peripheral area of the film on the frame. Afterward, the upper surface of the film is subjected to an oxygen or argon plasma process to induce activating groups thereon to facilitate the bond with a conductive material. The power for the plasma process is in the range of 100 to 1000 Watt and the plasma processing time is in the range of 10 to 120 seconds. The film can also be processed under 800 Watt of power for the plasma process for 20 seconds.

After the film is plasma processed, a first conveyer is used to convey the frame to a metal sputtering apparatus so as to form a conductive material layer on the film, such as an aluminum layer or a gold layer. The conductive material layer has a thickness of 0.01 to 1 μm. When the resulting conductive material layer is an aluminum layer, the rate for sputtering and depositing the aluminum layer on the dielectric film is about 1 to 20 angstroms per second. When the resulting conductive material layer is a gold layer, the rate for sputtering and depositing the gold layer on the dielectric film is about 0.1 to 5 angstroms per second. The voltage for the sputtering process is 400 to 1500 V. In addition, the distance between the dielectric film and a sputtering source used in the sputtering process is 10 to 30 cm. To prevent the film from damage in the sputtering process due to overheat, sputtering the conductive material on the dielectric film is required to be halted for at least 10 to 60 seconds after every time the film is subjected to a continuous sputtering of 10 to 60 seconds, so as to cool down the film and then to resume the sputtering again. After the conductive material layer is formed, the first conveyer conveys the frame away from the metal sputtering apparatus.

Afterward, the frame is picked up from the first conveyer and turned over manually or by a turnover apparatus with the lower surface of the dielectric film facing upward. Subsequently, the frame is placed on a second conveyer and then conveyed to a charging apparatus. A corona charging process is then performed to make the film become an electret diaphragm with long-lived static charges carried therein or thereon. The voltage utilized for the corona charging process is in the range of 10 kV to 20 kV and the electric current is in the range of 0.01 mA to 1 mA. The distance from the lower surface of the dielectric film to an electrode for the corona charging process is about 2 to 20 cm. After the film is polarized, the second conveyer conveys the frame away from the charging apparatus.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1A:
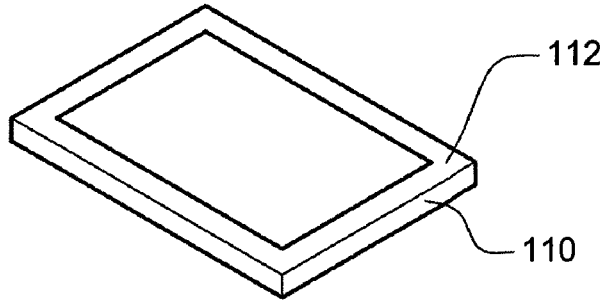
FIGS. 1*a* to 4 illustrate the method for manufacturing electret diaphragms according to the present invention.
Figure 1B:
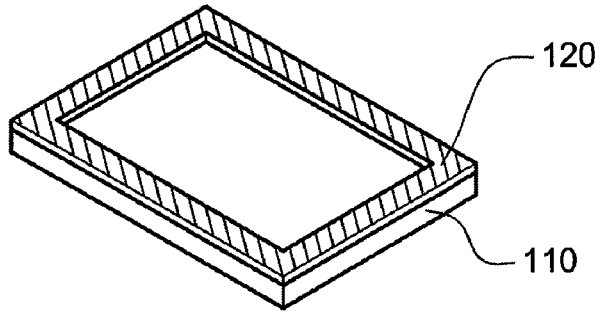
Figure 1C:
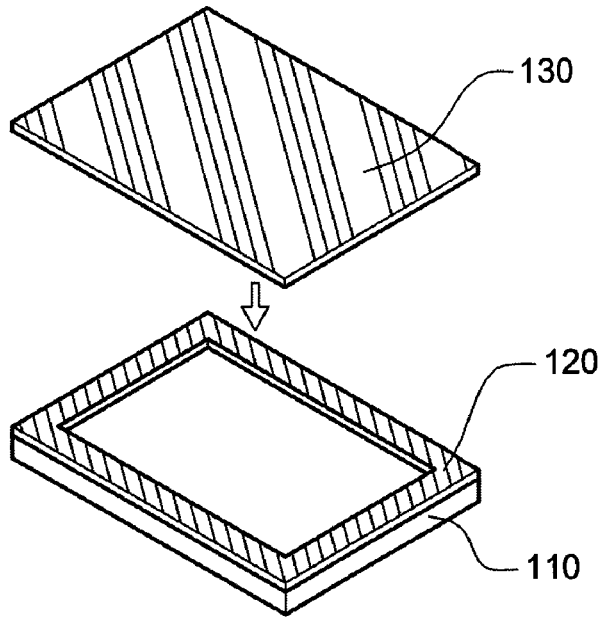
Figure 1D:
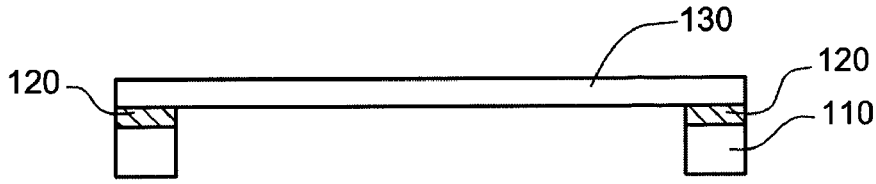
Figure 1E:
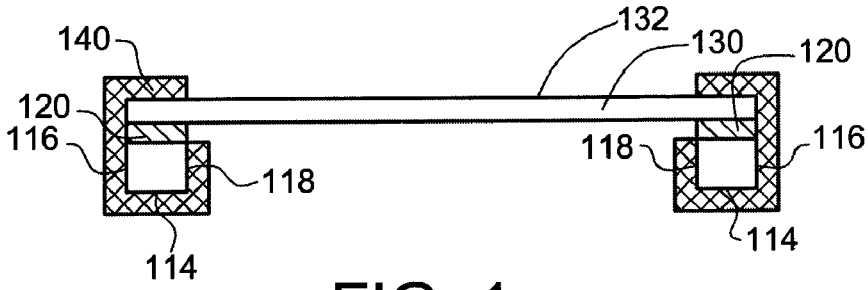

Referring to FIGS. 1*a* to 4, the method for manufacturing an electret diaphragm according to the present invention is first to provide a rigid annular frame 110 with an upper surface 112 (see FIG. 1*a*). Afterward, an adhesive material 120 is applied to the upper surface 112 of the frame 110 (see FIG. 1*b*) and a dielectric film 130 is attached to the adhesive material 120 on the upper surface 112 of the frame 110 (see FIGS. 1*c* and 1*d*). The film 130 can be made of fluorinated ethylene propylene (FEP), Polytetrafluoroethene (PTFE), Polyvinylidene Fluoride (PVDF), silicon dioxide ($SiO_2$) or other fluoride polymers. When the film 130 is used as the diaphragm of an electro-acoustic transducer, it is required to perform a polarizing process on the film 130 to generate static charges carried therein or thereon. The more the static charges are carried on the film 130, the stronger the vibration of the film 130 can be generated. The capacity of the film 130 for carrying static charges can be increased by increasing the thickness thereof However, the increase in the thickness of the film 130 leads to the increase in the mass thereof. A heavy film 130 is harder to be driven to vibrate. Therefore, to come to a balance, the film 130 has a thickness ranging from 1 to 50 μm when it is used to form the diaphragm of an electro-acoustic transducer, such as the diaphragm made of PTFE. Referring to FIG. 1*e*, after the film 130 is attached to the frame 110, a vacuum tape 140 functioning as a fastening element grips the peripheral area of the film 130 on the frame 110 such that the film 130 can be securely attached to and stretched tautly over the frame 110. The method for griping the film 130 on the frame 110 is to attach the vacuum tape 140 to the peripheral area of the upper surface 132 of the film 130 and to the outer side surface 116 and lower surface 114 of the frame 110. The vacuum tape 140 can also be optionally extended and attached to the inner side surface 118.

Figure 1F:
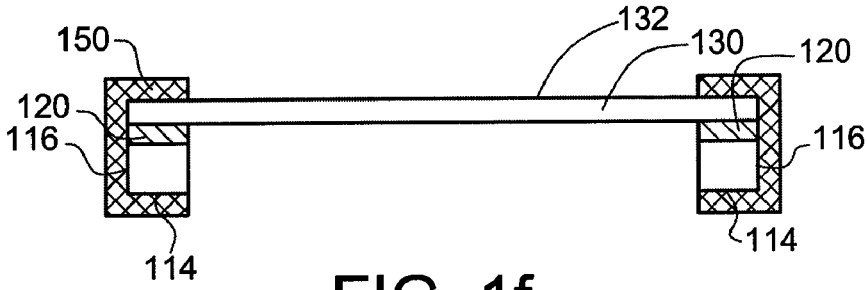

The method to stretch the film 130 tautly over the frame 110 according to the present invention is not limited to the use of the vacuum tape 140. Referring to FIG. 1*f*, a U-shaped clamping fixture 150 can also be used as a fastening element to grip the film 130 on the frame 110. The use of the clamping fixture 150 is to grip the peripheral area of the upper surface 132 of the film 130 on the frame 110 such that the film 130 can be securely attached to and stretched tautly over the frame 110. The material suitable for the clamping fixture 150 is one that is not prone to discharge gas in the vacuum environment, such as, metal or plastic and is shaped to clamp the edge of the film 130.

Figure 2:
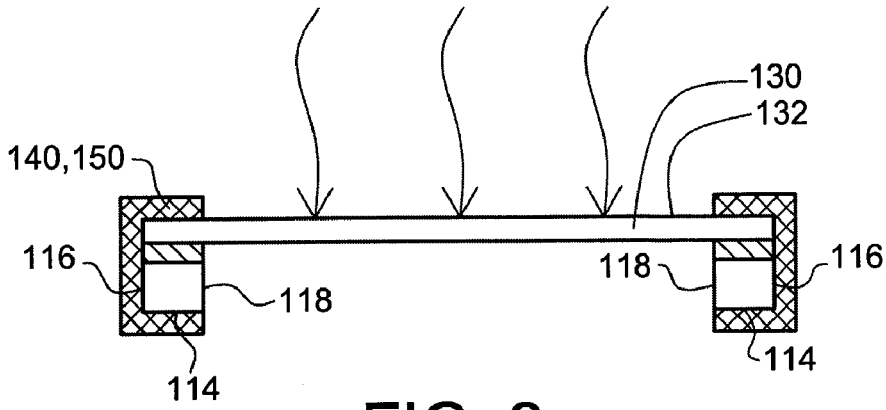

Afterward, referring to FIG. 2, the frame 110, together with the film 130 is placed in a vacuum environment and the upper surface 132 of the film 130 is processed with a plasma process, such as oxygen or argon plasma process to induce activated groups thereon to facilitate the bond with a conductive material. It will be appreciated that a high-powered and long-lasting plasma process can induce the activated groups more on the film 130. The large amount of activated groups is favorable for the bond with the conductive material. However, an undue plasma power or overtime plasma process will cause damage to the film 130. Therefore, according to the method of the present invention, the plasma power is in the range of 100 to 1000 Watts (W) and the plasma processing time is in the range of 10 to 120 seconds. The film 130 can also be processed under 800 W plasma power for 20 seconds.

Figure 3:
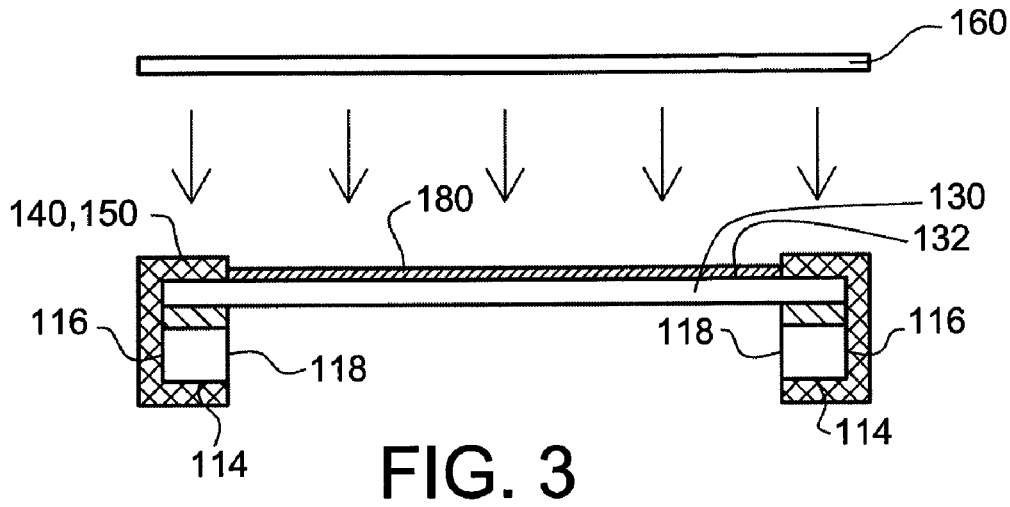

Referring to FIG. 3, after the film 130 is plasma processed, a conductive material layer 180, such as aluminum (Al) layer or gold (Au) layer is formed on the upper surface 132 of the film 130 by a process such as a sputtering process. The conductive material layer 180 has a thickness of 0.01 to 1 μm. When the conductive material layer 180 is an aluminum layer, the rate for sputtering and depositing the aluminum layer 180 on the film 130 ranges from about 1 to 20 angstroms per second (A/sec). Alternatively, when the conductive material layer 180 is a gold layer, the rate for sputtering and depositing the gold layer 180 on the film 130 ranges from about 0.1 to 5 angstroms per second (A/sec). The sputtering voltage for the sputtering process is in the range of 400 to 1500 volts (V). Furthermore, if the distance from the film 130 to a sputtering source 160 used in the sputtering process is too short, the film 130 is prone to damage. On the other hand, when the distance between the film 130 and sputtering source 160 is too far, the sputtering efficiency is very poor. Therefore, the distance between the film 130 and sputtering source 160 is in the range of 10 to 30 centimeters (cm). To prevent the film 130 from damage in the sputtering process due to overheat, the sputtering is required to be halted for at least 10 to 60 seconds after every time the film is subjected to a continuous sputtering of 10 to 60 seconds, so as to cool down the film 130 and then to resume the sputtering again. The sputtering will be continued until a desired thickness of the conductive material layer 180 is formed.

Figure 4:
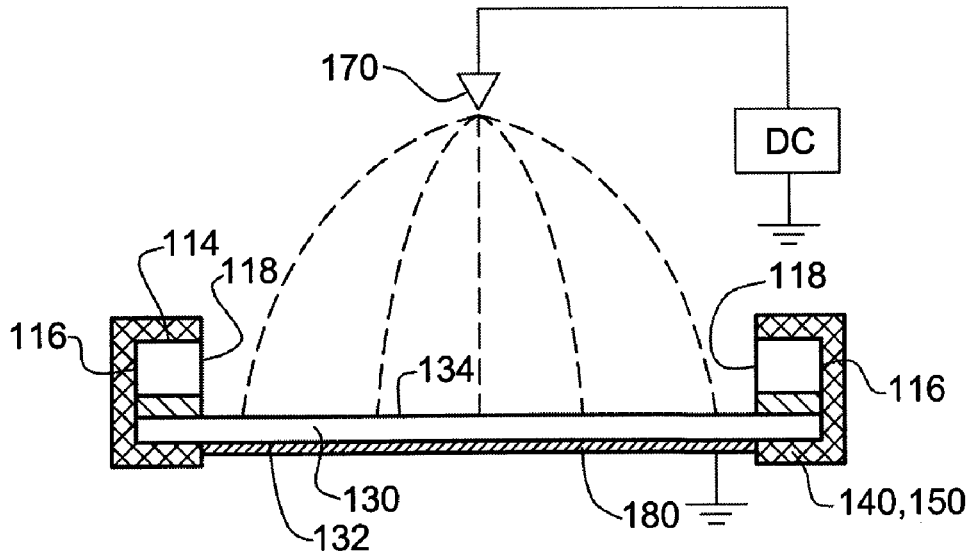

Referring to FIG. 4, after the conductive material layer 180 is formed on the film 130 with the sputtering process, it is required to perform a polarizing process, such as corona charging process to make the film 130 become an electret diaphragm with long-lived static charges carried therein or thereon when it is used as the diaphragm of an electro-acoustic transducer. The voltage utilized for the corona charging process is in the range of 10 kV to 20 kV and the electric current is in the range of 0.01 mA to 1 mA. The distance from the lower surface 134 of the film 130 to an electrode 170 for the corona charging process is about 2 to 20 cm and the conductive material layer 180 has to be grounded.

Figure 5:
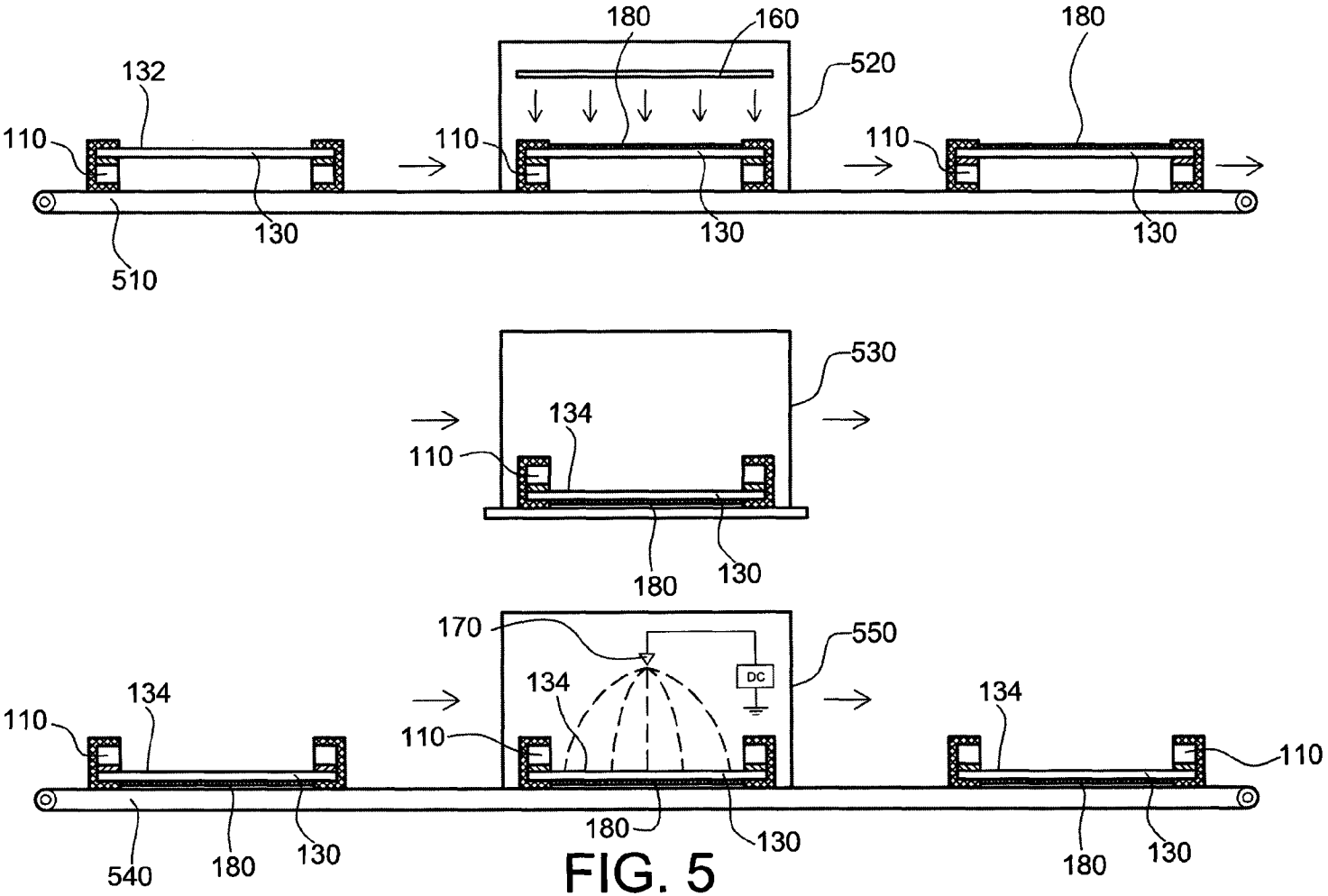
FIG. 5 illustrates the method for manufacturing electret diaphragms according to the present invention, wherein conveyers are used to manufacture the electret diaphragms.

In addition, according to the method of the present invention, conveyers can be used to expedite the production of electret diaphragms. For example, referring to FIG. 5, after the film 130 is plasma processed, the frame 110 together with the film 130 is placed on a first conveyer 510 with the upper surface 132 of the film 130 facing upward. The frame 110 is then conveyed by the conveyer 510 to a metal sputtering apparatus 520 so as to form therein the conductive material layer 180 on the upper surface 132 of the film 130 by a sputtering process. Afterward, the conveyer 510 conveys the frame 110 away from the metal sputtering apparatus 520.

Subsequently, the frame 110 is picked up from the conveyer 510 and turned over manually or by a turnover apparatus 530 with the lower surface 134 of the film 130 facing upward. Next, the frame 110 turned over is placed on a second conveyer 540 and then conveyed to a charging apparatus 550 to polarize the film 130 therein by a corona charging process. After the film 130 is polarized, the second conveyer 540 conveys the frame 110 away from the charging apparatus 550.

According to the method of the present invention, the fastening element, such as the vacuum tape or clamping fixture is used to stretch the dielectric film tautly over the frame. In addition, since the electret diaphragm can be manufactured in compliance with the process parameters of the sputtering and polarizing processes described in the present invention, the conductive material on the electret diaphragm is not prone to separate from the dielectric film. Moreover, the conveyers can be used to expedite the production of the electret diaphragms.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for manufacturing an electret diaphragm, comprising:

providing a frame with an upper surface and a lower surface;

applying an adhesive material to the upper surface of the frame;

attaching a dielectric film to the adhesive material on the upper surface of the frame, the dielectric film having an upper surface and a lower surface;

providing a clamping element to clamp the peripheral area of the dielectric film on the frame;

forming a conductive material layer on the upper surface of the dielectric film with the peripheral area of the dielectric film clamped on the frame by the clamping element; and polarizing the dielectric film.

2. The method as claimed in claim 1, wherein the forming of the conductive material layer on the upper surface of the dielectric film comprises:

processing the upper surface of the dielectric film with a plasma process; and sputtering the conductive material layer on the upper surface of the dielectric film with a sputtering process.

3. The method as claimed in claim 2, wherein the processing of the upper surface of the dielectric film comprises:

applying 100 to 1000 Watt oxygen or argon plasma to process the upper surface of the dielectric film for 10 to 120 seconds.

4. The method as claimed in claim 2, wherein the dielectric film has a thickness of 1 to 50 μm.

5. The method as claimed in claim 2, wherein a voltage for the sputtering process is 400 to 1500 V.

6. The method as claimed in claim 2, wherein the conductive material layer has a thickness of 0.01 to 1 μm.

7. The method as claimed in claim 6, wherein the conductive material layer is an aluminum layer, and the rate for sputtering and depositing the aluminum layer on the dielectric film is about 1 to 20 angstroms per second.

8. The method as claimed in claim 6, wherein the conductive material layer is a gold layer, and the rate for sputtering and depositing the gold layer on the dielectric film is about 0.1 to 5 angstroms per second.

9. The method as claimed in claim 2, wherein the distance between the dielectric film and a sputtering source used in the sputtering process is 10 to 30 cm.

10. The method as claimed in claim 2, wherein the forming of the conductive material layer on the upper surface of the dielectric film further comprises:

halting sputtering the conductive material on the dielectric film to cool down the dielectric film after the dielectric film is subjected to a continuous sputtering of 10 to 60 seconds.

11. The method as claimed in claim 10, wherein the forming of the conductive material layer on the upper surface of the dielectric film further comprises:

resuming sputtering the conductive material on the dielectric film after halting sputtering the conductive material on the dielectric film for 10 to 60 seconds.

12. The method as claimed in claim 2, wherein the processing of the upper surface of the dielectric film comprises:

applying 800 Watt oxygen or argon plasma to process the upper surface of the dielectric film for 20 seconds.

13. The method as claimed in claim 1, wherein the forming of the conductive material layer on the upper surface of the dielectric film comprises:

placing the frame on a first conveyer;

conveying the frame to a metal sputtering apparatus by the first conveyer; and forming the conductive material layer on the upper surface of the dielectric film in the metal sputtering apparatus.

14. The method as claimed in claim 13, wherein the forming of the conductive material layer on the upper surface of the dielectric film further comprises:

conveying the frame away from the metal sputtering apparatus by the first conveyer after the conductive material layer is formed.

15. The method as claimed in claim 14, further comprising:

picking up the frame from the first conveyer after the first conveyer conveys the frame away from the metal sputtering apparatus; and turning over the frame with the lower surface of the dielectric film facing upward so as to perform the polarizing of the dielectric film.

16. The method as claimed in claim 15, wherein the polarizing of the dielectric film comprises:

placing the frame turned over on a second conveyer;

conveying the frame to a charging apparatus by the second conveyer; and polarizing the dielectric film by a corona charging process in the charging apparatus.

17. The method as claimed in claim 16, wherein a voltage utilized for the corona charging process is in the range of 10 kV to 20 kV and the electric current for the corona charging process is in the range of 0.01 mA to 1 mA.

18. The method as claimed in claim 17, wherein the distance from the lower surface of the dielectric film to an electrode for the corona charging process is 2 to 20 cm.

19. The method as claimed in claim 1, wherein the fastening element is a vacuum tape, which is attached to the peripheral area of the dielectric film and to the lower surface of the frame.

20. The method as claimed in claim 1, wherein the clamping element is a U-shaped clamping element.

* * * * *